US006808660B2

(12) United States Patent
Schwarzbich

(10) Patent No.: US 6,808,660 B2
(45) Date of Patent: Oct. 26, 2004

(54) METHOD FOR PRODUCING A RAIL SUBSTRUCTURE

(76) Inventor: Jörg Schwarzbich, Wertherstrasse 15, Bielefeld (DE), D-33615

( * ) Notice: Subject to any disclaimer, the term of this patent is extended or adjusted under 35 U.S.C. 154(b) by 424 days.

(21) Appl. No.: 10/012,833

(22) Filed: Oct. 30, 2001

(65) Prior Publication Data

US 2002/0053749 A1 May 9, 2002

(30) Foreign Application Priority Data

Oct. 31, 2000 (DE) ..... 100 54 041

(51) Int. Cl.[7] ..... E04B 1/16
(52) U.S. Cl. ..... 264/35; 264/31; 264/71; 238/5
(58) Field of Search ..... 264/35, 71, 169

(56) References Cited

U.S. PATENT DOCUMENTS

| | | | | |
|---|---|---|---|---|
| 2,787,186 A | | 4/1957 | Brogiotti | |
| 3,552,734 A | * | 1/1971 | Severino et al. | 269/287 |
| 3,685,783 A | * | 8/1972 | Hilson | 249/94 |
| 4,493,584 A | * | 1/1985 | Guntert | 404/74 |
| 6,431,517 B1 | * | 8/2002 | Chapman | 249/93 |

FOREIGN PATENT DOCUMENTS

| | | | | |
|---|---|---|---|---|
| DE | 319972 | | 4/1920 | |
| DE | 2422942 | | 11/1975 | |
| DE | 19639142 | | 4/1998 | |
| DE | 19808812 | | 9/1999 | |
| EP | 0735189 | | 10/1996 | |
| EP | 0824165 | * | 2/1998 | E01C/23/04 |
| WO | WO 9727366 | | 7/1997 | |

* cited by examiner

*Primary Examiner*—Michael P. Colaianni
*Assistant Examiner*—Michelle Acevedo Lazor
(74) *Attorney, Agent, or Firm*—Richard M. Goldberg

(57) ABSTRACT

A method for producing a rail substructure for railroad tracks, for which a rail bed is concreted and dowels are anchored positively in the concrete in order to fasten the rails, such that the dowels are inserted into the still deformable concrete during the concreting of the track bed.

13 Claims, 3 Drawing Sheets

METHOD FOR PRODUCING A RAIL SUBSTRUCTURE

BACKGROUND OF THE INVENTION

The invention relates to a method for producing a rail substructure for railroad tracks, for which a rail bed is concreted and dowels are used to anchor the rails positively in the concrete.

For conventional railroad tracks, the substructure generally consists of a bed of road metal and railroad ties of wood or concrete, to which fastening claws are attached with bolts, so that the rails can be fastened adjustably. If the railroad ties are fabricated parts made from concrete, the dowels, into which the bolts are screwed later on, are cast in the finished concrete parts already during the manufacture of the railroad ties. The dowels can thus be anchored reliably in the concrete.

Rail substructures are also already known, for which a rail bed of concrete is provided instead of a bed of road metal. In the case of a known method for producing such a rail substructure, a rail bed is concreted with a flat surface in a first concreting step. When the concrete has set, the prefabricated railroad ties are placed upon it. These railroad ties are then concreted in a second step in a further layer of concrete. However, this method is time-consuming and costly.

SUMMARY OF THE INVENTION

It is an object of the invention to indicate a method of the type named above, which makes it possible to produce rail substructure more easily, more quickly and less expensively.

Pursuant to the invention, this objective is accomplished owing to the fact that, when concreting the rail bed, the dowels are inserted in the concrete, while the latter is still deformable.

This method has the advantage that pre-fabricated railroad ties are no longer required and that the rail substructure can be produced rationally in a single concreting step.

In the simplest case, the positive anchoring of the dowels in the concrete can be achieved owing to the fact that the dowels, which are provided with outwardly protruding projections, are simply pressed from above into the soft concrete. Since the concrete is still somewhat flowable, it flows around all the projections, so that the desired positive connection is brought about. In order to increase the reliability of this method, it is possible, after the dowels have been inserted, to consolidate the concrete with the help of a shaker or the like, the dowels being held in position during the shaking preferably with the help of an inserted mandrel. Moreover, it is possible to carry out the consolidation process so that, at the same time, railroad tie-like elevations are formed in the surface of the track bed at the same time, either in the form of continuous railroad ties for both rails or in the form of two isolated islands, on which in each case a single rail is to be fastened. At the same time, this method has the advantage that, during the consolidation process, there is flow of material in the still deformable concrete in the direction of the islands and, with that, in the direction of the dowels, so that the flow of concrete around the dowels is supported.

Another possibility for ensuring a reliable positive connection between the dowels and the concrete consists therein that the dowels are formed as straddling dowels, which initially are pressed into the concrete in the unexpanded state and expanded only then, so that they are set positively into the surrounding concrete. Since the expansion of the dowels at the same time leads to a consolidation of the surrounding concrete, reliable anchoring of the dowels can be achieved.

Pursuant to a further variation of the method, which is regarded as particularly preferred at the present time, the dowels are provided with thread-like projections on their peripheral surface and, as they are lowered into the concrete, are caused to rotate, so that they are screwed into the concrete. In this way, it can be achieved that the spaces between the projections are filled with concrete from the very start and, with that, a reliable indenting of the dowels in the concrete is achieved.

A dowel for implementing this variation of the method is also an object of the invention.

Preferably, an internal thread, into which later on the bolt for fastening the rail foot claw can be screwed, is prepared in the dowel. So that this thread (machine thread) does not become contaminated prematurely with concrete, the dowel preferably has a closing mechanism for temporarily closing the upper opening of the dowel. This closing mechanism can be formed by an inserted or slipped-on cap, a slider, by soft lips or by closing elements with break-off sites, which are gated to the dowel.

BRIEF DESCRIPTION OF THE DRAWINGS

In the following, examples of the invention are explained in greater detail by means of the drawing, in which.

DETAILED DESCRIPTION

Figure 1:
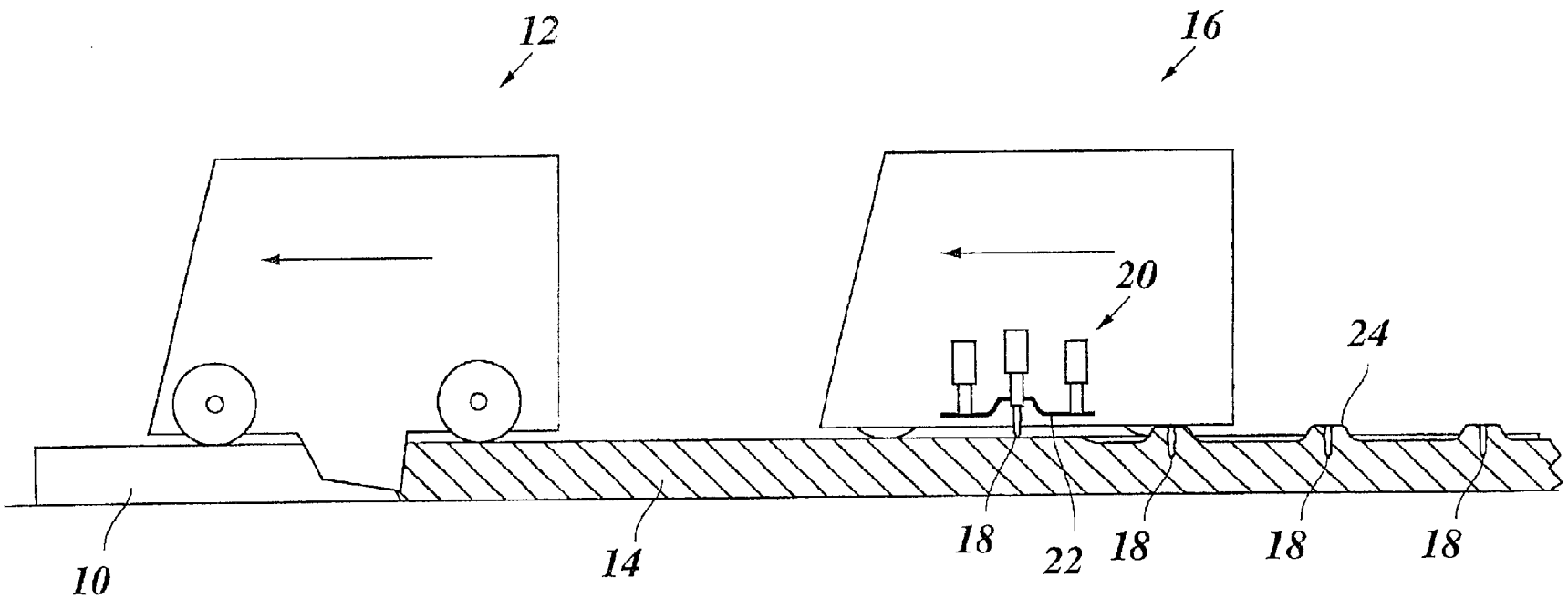
FIG. 1 shows a diagrammatic sketch to explain the method.

For the method shown in FIG. 1, temporary rails 10 for a concreting carriage 12 are put down first. With the help of the concreting carriage 12 traveling on the rails 10, a flat track bed 14 is concreted in the space between the two rails 10.

The concreting carriage 12 is followed by a dowel-setting machine 16, which also runs on the rails 10. Alternatively, the dowel-setting machine may also be integrated in the concreting carriage 12. With the help of the dowel-setting machine 16, the plastic dowels 18 are pressed at regular intervals, corresponding to the distances between the railroad ties of a conventional rail substructure, into the still deformable concrete. By the curing of the concrete, the dowels are anchored firmly in the concrete. In each dowel-setting step, a total of four dowels is set, two for each of the rails of the track. However, only one of these four dowels can be seen in FIG. 1.

In the example shown, the dowel-setting machine is combined with a shaker 20, which, with the help of a molding plate 22, deforms the surface of the track bed 14, so that railroad tie elevations 24 are formed, which in each case surround two dowels 18, which are assigned to the same rail. During shaking, material flows from the spaces between the elevations 24 into the region of the elevations, that is, in the direction of the dowels 18, and the concrete material is consolidated in the immediate vicinity of the dowels, so that a firm anchorage of the dowels in the concrete is achieved.

In a modified embodiment of the method, however, the formation of the elevations 24 can be omitted. The dowels are then simply inserted into the flat track bed 14 and, correspondingly, the rails are also laid on the flat track bed. In a further variation of the method, it is possible, with the help of the concreting machine 12, to produce a track bed, which has two parallel, continuously "extruded" elevations, on which the two rails are then mounted. Accordingly, greater clearance of the rail-bound vehicles is achieved in the region between the rails.

Two examples of the dowels 18, with which positive anchorage of the dowels in the track bed 14 can be ensured with high reliability, are described below.

Figure 2:
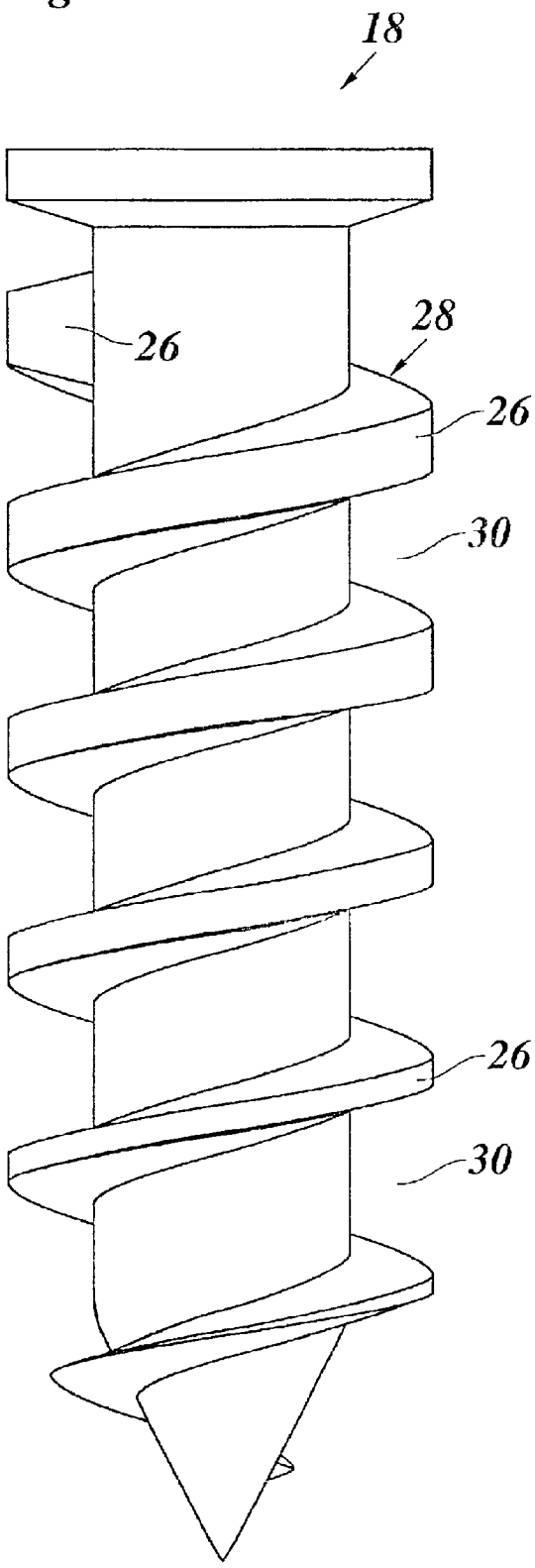
FIGS. 2 and 3 show a side view of and an axial section of a dowel for a first embodiment of the method and FIGS. 4 and 5 show axial sections of a straddling dowel for a second embodiment of the method in different stages during the insertion of the dowel in the concrete.
Figure 3:
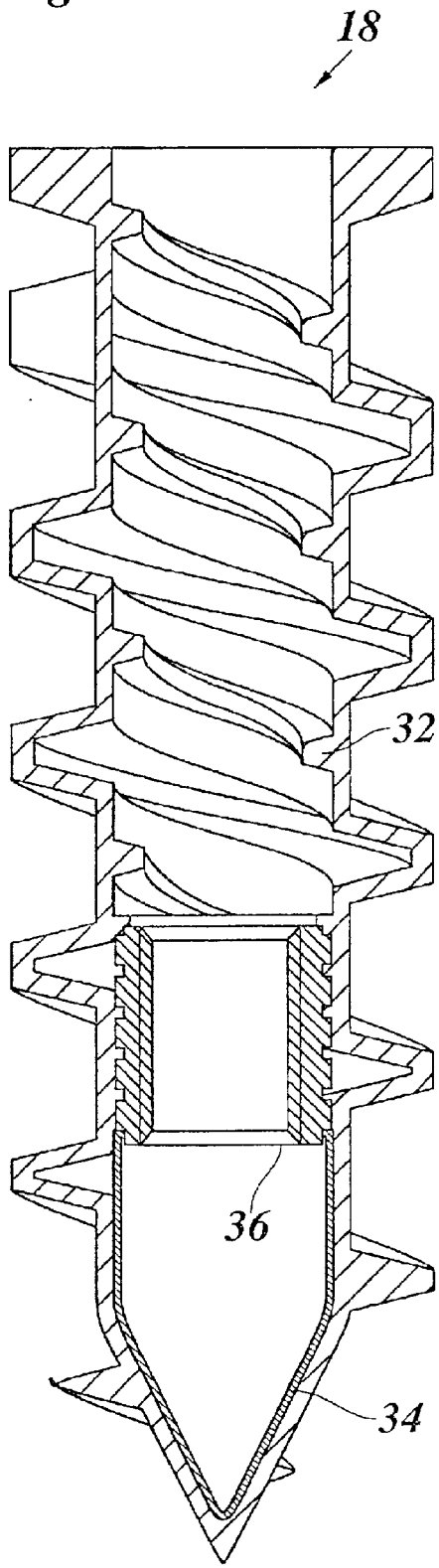

FIGS. 2 and 3 show a plastic dowel 18, which, on its outer peripheral surface, has an arrangement of projections 26, which form a continuous screw thread 28 with a constant slope. The projections 26 have a trapezoidal cross section and their height increases steadily from the upper to the lower end of the dowel. As a result, the spaces 30 between the individual threads become smaller from the bottom to the top.

With the help of the dowel setting machine 16, the dowel 18 is lowered at a constant rate from above into the track bed 14 and, at the same time, rotates about its vertical axis at a suitably adapted rate, so that the dowel is screwed into the soft concrete composition, without displacing the concrete material from the interstices 30. In contrast to this, the composition, displaced from the core region of the dowel, leads to a consolidation of the concrete and moreover, especially in the upper region of the dowel there is further consolidation of the material present there due to the decrease in the space between the threads. In this way, an entirely reliable anchorage of the dowel in the concrete is achieved.

As shown in FIG. 3, the hollow dowel 18 is reinforced in the upper region on the inside by helical reinforcing ribs 32. The tip of the dowel is reinforced by an injected insert 34. Between the upper region, reinforced by the reinforcing ribs 32, and the insert 34, a tapped bush 36 is injected and firmly interlocked with the surrounding plastic. A bolt, which is not shown and is used for fastening to the rail foot claw, can be screwed later on into the internal thread of this tapped bush 36.

While the dowel 18 is lowered into the track bed 14 with the help of the dowel-setting machine, it is held on a mandrel of the dowel-setting machine, which extends through the tapped bush 36 into the tip of the dowel and, accordingly, fixes the dowel stably in its position. In this way, a precisely vertical alignment and a positionally correct setting of the dowel is made possible. Subsequently, the mandrel can be pulled freely upward from the dowel. Optionally, this takes place together with the lifting of the mold plate 22, which is shown in FIG. 1.

Figure 4:
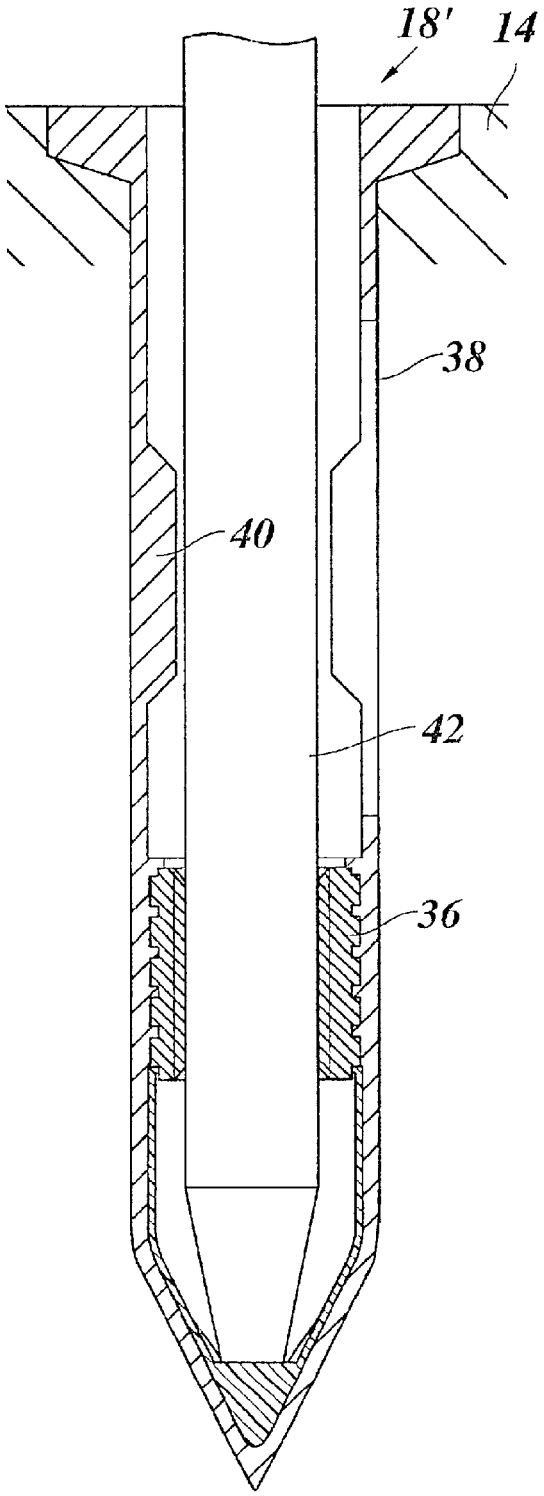
Figure 5:
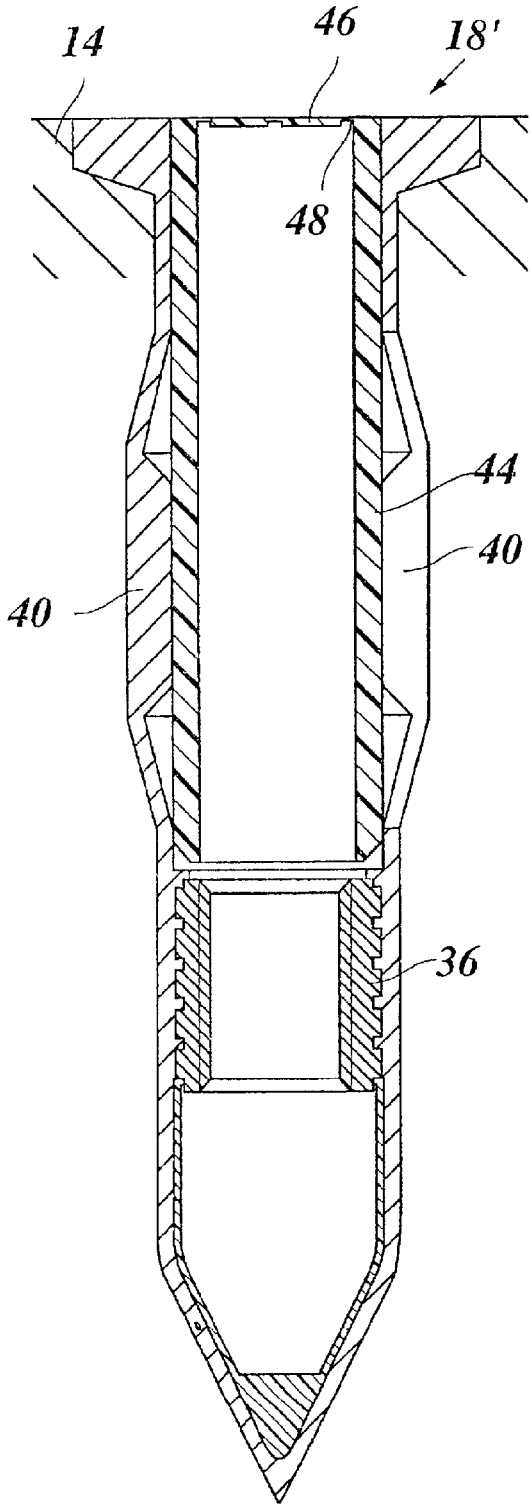

As further examples, FIGS. 4 and 5 show a dowel 18', which is constructed as a straddling dowel. In the state, shown in FIG. 4, this dowel 18' has a smooth, outer peripheral surface. The mantle wall of the dowel is, however, interrupted on a portion of its length by vertical slots 38. Between these slots and distributed over the periphery, the mantle wall forms inwardly protruding projections 40, which are sloped at the upper and lower ends and, in the center of the dowel, leave a channel for the already mentioned mandrel 42 of the setting machine. This mandrel extends through the tapped bush 36 up to the tip of the dowel.

With the help of the mandrel 42, the dowel 18', to begin with, is pressed into the fresh track bed 14 in the state shown in FIG. 4, the concrete material in the vicinity of the dowel being consolidated. Subsequently, the mandrel 42 of the dowel-setting machine moves back upward and, within the dowel-setting machine, an expansion sleeve 44 (FIG. 5) is moved into a position, in which it is centered on the axis of the dowel 18'. With the help of a tubular stamp, which surrounds the mandrel 42, the expansion sleeve 44 is then pressed downward into the dowel 18', as shown in FIG. 5. At the same time, the projections 40 are pressed outward, so that they are pressed outwards into the concrete and bring about a positive anchoring of the dowel in the concrete. The expansion sleeve 44 remains in the dowel. Its internal diameter is large enough so that the bolt can be screwed into the tapped bush 36 later on.

In the example shown, the expansion sleeve 44 is closed by a gated sealing plate 46, which is weakened by break-off sites 48. The concrete mortar is prevented from penetrating into the dowel and contaminating the internal thread of the tapped bush 36 by this sealing plate 46. Later on, when the bolt is to be screwed, the sealing plate 46 can simply be ruptured with the end of the bolt. The material of the sealing plate then remains in the space between the bolt and the expansion sleeve 44.

A sealing device, corresponding to the sealing plate 46, can also be provided in the case of the dowel 18 of FIGS. 2 and 3. In this case, however, the sealing device must be constructed so that, when the mandrel 42 is introduced, it yields and then, later on, it can assume, optionally automatically, its closed position once again. This can be achieved, for example, owing to the fact that the sealing plate is formed by soft lips or by elastic, circular tongues, which open and close in the manner of a heart valve.

What is claimed is:

1. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, wherein the step of concreting includes the step of shaking a concrete composition of the track bed during the insertion of the dowel so that the track bed forms railroad tie-like elevations which in each case enclose at least a pair of the dowels set at the same height, and further comprising the step of holding the dowels in position by an inserted mandrel during the shaking.

2. The method of claim 1, further comprising the step of expanding the dowel after it is lowered into the track bed.

3. The method of claim 1, wherein an outer periphery of the dowel has projections, which are formed in the manner of a screw thread, and wherein the step of inserting includes the step of screwing the dowel into the track bed.

4. The method of claim 1, further comprising the step of closing off an upper end of the dowel after it is inserted in the track bed, by a removable sealing device.

5. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, and expanding the dowel after it is lowered into the track bed.

6. The method of claim 5, further comprising the step of closing off an upper end of the dowel after it is inserted in the track bed, by a removable sealing device.

7. A method for producing a rail substructure for railroad tracks, comprising the steps of:

concreting a track bed, and anchoring dowels positively in the concrete in order to fasten the rails, including the step of inserting the dowels into the concrete while the concrete is still deformable, during the concreting of the track bed, wherein an outer periphery of the dowel has projections, which are formed in the manner of a screw thread, and wherein the step of inserting includes the step of screwing the dowel into the track bed.

8. The method of claim 7, further comprising the step of closing off an upper end of the dowel after it is inserted in the track bed, by a removable sealing device.

9. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, and closing off an upper end of the dowel after it is inserted in the track bed, by a removable sealing device.

10. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, the step of inserting including the steps of:

inserting the dowels with a dowel-setting machine which moves over the track bed, and lowering the dowels at uniform intervals into the track bed, wherein the step of concreting includes the step of shaking a concrete composition of the track bed during the insertion of the dowel so that the track bed forms railroad tie-like elevations which in each case enclose at least a pair of the dowels set at the same height, and further comprising the step of holding the dowels in position by an inserted mandrel during the shaking.

11. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, the step of inserting including the steps of:

inserting the dowels with a dowel-setting machine which moves over the track bed, and lowering the dowels at uniform intervals into the track bed, and expanding the dowel after it is lowered into the track bed.

12. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, the step of inserting including the steps of:

inserting the dowels with a dowel-setting machine which moves over the track bed, and lowering the dowels at uniform intervals into the track bed, wherein an outer periphery of the dowel has projections, which are formed in the manner of a screw thread, and wherein the step of inserting includes the step of screwing the dowel into the track bed.

13. A method for producing a rail substructure for railroad tracks, comprising the steps of:

concreting a track bed, anchoring dowels positively in the concrete in order to fasten the rails, including the step of inserting the dowels into the concrete while the concrete is still deformable, during the concreting of the track bed, the step of inserting including the steps of:

inserting the dowels with a dowel-setting machine which moves over the track bed, and lowering the dowels at uniform intervals into the track bed, and closing off an upper end of the dowel after it is inserted in the track bed, by a removable sealing device.

* * * * *